US006622368B1

(12) United States Patent
Müllenborn et al.

(10) Patent No.: US 6,622,368 B1
(45) Date of Patent: Sep. 23, 2003

(54) METHOD OF MANUFACTURING A TRANSDUCER HAVING A DIAPHRAGM WITH A PREDETERMINED TENSION

(75) Inventors: Matthias Müllenborn, Lyngby (DK); Pirmin Rombach, Lyngby (DK)

(73) Assignee: SonionMEMS A/S, Lyngby (DK)

( * ) Notice: Subject to any disclaimer, the term of this patent is extended or adjusted under 35 U.S.C. 154(b) by 0 days.

(21) Appl. No.: 09/719,208

(22) PCT Filed: Jun. 10, 1999

(86) PCT No.: PCT/DK99/00315

§ 371 (c)(1),
(2), (4) Date: Jan. 5, 2001

(87) PCT Pub. No.: WO99/65277

PCT Pub. Date: Dec. 16, 1999

(30) Foreign Application Priority Data

Jun. 11, 1998 (DK) ..... 1998 00791

(51) Int. Cl.[7] ..... H04R 31/00

(52) U.S. Cl. ..... 29/594; 29/25.41; 29/607.1; 29/595; 361/283.2; 361/283.4; 73/514.32

(58) Field of Search ..... 29/594, 25.41, 29/847, 592.1, 609.1, 595, 603.01; 361/283.2, 283.4; 73/514.32, 753, 774; 381/174

(56) References Cited

U.S. PATENT DOCUMENTS 3,978,731 A * 9/1976 Reeder et al. ..... 73/407
4,872,945 A * 10/1989 Myers et al. ..... 156/627
5,170,283 A * 12/1992 O'Brien et al. ..... 359/291
5,177,579 A * 1/1993 Jerman ..... 73/724
5,408,731 A * 4/1995 Berggvist et al. ..... 29/25.41
5,573,679 A * 11/1996 Mitchell et al. ..... 216/2
6,030,851 A * 2/2000 Grandmont et al. ..... 438/53
6,345,424 B1 * 2/2002 Hasegawa et al. ..... 29/25.35
6,522,762 B1 * 2/2003 Mullenborn et al. ..... 381/174
2001/0020320 A1 * 9/2001 McIntosh et al. ..... 29/25.41

FOREIGN PATENT DOCUMENTS

WO WO 97/39464 * 10/1997
WO WO 99/65277 * 12/1999

* cited by examiner

*Primary Examiner*—Carl J. Arbes
*Assistant Examiner*—Minh Trinh
(74) *Attorney, Agent, or Firm*—Dykema Gossett PLLC

(57) ABSTRACT

A method of manufacturing a transducer of the type having a diaphragm (11) with a predetermined tension. After the transducer has been manufactured with its basic structure the diaphragm is adjusted to have a predetermined tension, which is preferably low in order to obtain a high sensitivity. Two embodiments are disclosed. One embodiment includes heating the transducer to a temperature above the glass transition temperature of the material (12, 14) retaining the diaphragm. Another embodiment includes measuring the actual tension of the diaphragm, which can be used to calculate an adjustment of the thickness of the diaphragm resulting in the desired tension.

9 Claims, 1 Drawing Sheet

Figure 1:
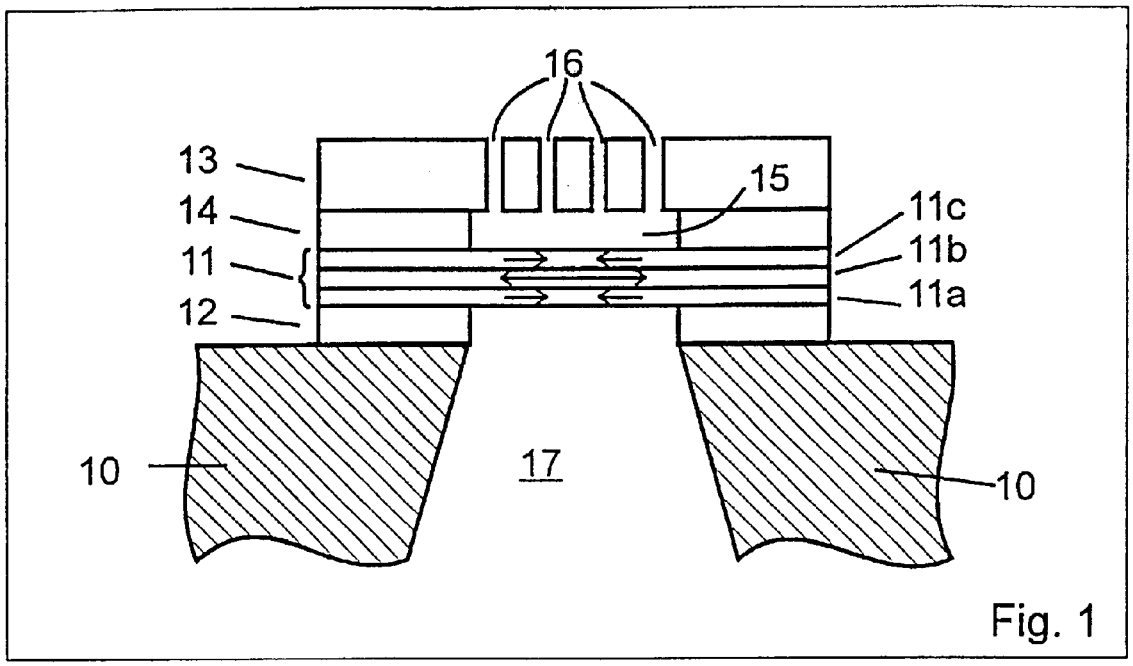

METHOD OF MANUFACTURING A TRANSDUCER HAVING A DIAPHRAGM WITH A PREDETERMINED TENSION

This invention concerns a method of manufacturing a transducer having a diaphragm with a predetermined tension such as a microphone. Most microphones have a diaphragm which is caused to move by the sound pressure such as microphones with electrodynamic, piezoelectric, piezoresistive, or capacitive readout. The method of the invention applies to all such types of transducers having a diaphragm.

In particular, a condenser microphone has as its basic components a diaphragm or membrane mounted in close proximity of a back plate. The diaphragm is retained along its periphery and can move or deflect in response to a sound pressure acting on a surface of the diaphragm. Together the diaphragm and the back plate form an electric capacitor, and when the diaphragm is deflected due to the sound pressure, the capacitance of the capacitor will vary. In use the capacitor will be charged with an electric charge corresponding to a DC voltage, and when the capacitance varies in response to the varying sound pressure, an electric AC voltage corresponding to the varying sound pressure will be superimposed on the DC voltage. This AC voltage is used as the output signal from the microphone.

A diaphragm with a low tension is "soft" and will deflect more than a diaphragm with a high tension, resulting in a higher sensitivity, which is desirable. The diaphragm of a microphone of the type considered should therefore have a well defined low tension.

Micromachined microphones have been developed by different research laboratories with applications such as in the telecommunication and hearing industry markets. One of the most challenging problems in the design and manufacturing of micromachined microphones is the controlled low tension of the diaphragm. Different sound detection principles have been suggested such as capacitive, piezoelectric, piezoresistive, optical, and tunneling read out. Most of which require a diaphragm with a tension below 50 N/m. In particular, battery-operated capacitive microphones with a low bias voltage of a few volts require very accurate control of the stress level in the diaphragm.

Conventionally, a diaphragm is glued to a metal frame using weights at the rim of the frame to adjust the tension of the diaphragm. This technique is not applicable to micromachining technology.

In micro-technology the tension of the diaphragm can be adjusted by developing new materials (e.g. silicon-rich silicon nitride), new deposition techniques (e.g. Plasma-Enhanced Chemical Vapor Deposition), new deposition conditions (e.g. by varying the temperature in a Low Pressure Chemical Vapor Deposition furnace), or subsequent temperature treatments (annealing treatments). Also the suspension of the diaphragm can relax tension e.g. through corrugations, hinges, springs, or in the most extreme case by suspending a plate.

However, the techniques currently used in micro-technology are either not reproducible and controllable enough for microphones in the above mentioned applications, or they impose other technological difficulties such as bending of suspensions and diaphragm due to a stress profile/gradient in the diaphragm.

*Sensors and Actuators* A. 31, 1992, 90–96 describes a transducer with a composite membrane consisting of two layers having compressive and tensile internal stress, respectively. It is described that by varying the relative thickness of the layers, the resulting internal stress can be controlled, but no method or means for doing so is disclosed.

This invention proposes a new method which can be used to tune the diaphragm stress to a predetermined level during or after processing of a micromachined microphone.

The diaphragm of the microphone resulting from the process of this invention is a sandwich of two or more layers (multi-layer, laminate, or composite) deposited on a rigid or stiff substrate. The diaphragm is formed by etching a hole into the substrate leaving the multi-layer as the diaphragm across the etched hole. In general, the layers of the diaphragm have different stress levels such as a layer of compressively stressed material and a layer of tensile stressed material, but the layers can both have compressive stress or tensile stress. This allows to achieve a desired tension level (tension=stress*thickness) by choosing the right ratio of the thicknesses of these materials. A thicker tensile layer will shift the total tension of the diaphragm to more tension, while a thicker compressively stressed material will shift the stress to more compression.

By adjusting the thickness ratio of the layers by the method according to the invention the tension can be controlled much more accurately than by any other attempt to achieve a certain stress or tension level, because thickness can be controlled almost down to the atomic level in micro-technology. It allows to deposit layers in a stable regime, where the materials have little variations in their mechanical properties. The correct stress level is adjusted by choosing the correct mixture of materials rather than the correct materials properties. Furthermore, the total thickness of the diaphragm can be chosen independently of the stress/tension level.

The total stress can be changed after deposition of the layers by changing the thickness of one or both of the outer layers. This can be done by known methods such as dry or wet etching to remove material from the outer layers, or by deposition/absorption of material to achieve thicker outer layers. Deposition on or etching of the outer layers will change the ratio of thickness. The stress or tension level of the composite diaphragm will thereby change. Etching processes can be wet etching processes using reactants such as HF, phosphoric acid, KOH, etc. or dry etching processes such as Reactive Ion Etching. Low etching rates can easily be achieved to support a controlled, accurate, and uniform removal of material. Deposition processes for tuning include physical and chemical vapor deposition.

The processes used for batch manufacturing of transducers according to the invention are very accurate and reproducible, and within one batch transducers can be manufactured with very small deviations between transducers in the same batch. This means that, with the claimed method, it is not necessary to measure the actual diaphragm tension on each individual transducer before adjusting the tension. It suffices to measure the actual diaphragm tension on selected transducers on selected wafers in the batch, and with sufficiently precise and predictable processes it is even not necessary to measure the actual diaphragm tension of transducers in every batch.

The resulting diaphragms can be applied in many types of transducers such as condenser and other microphones, and specifically, in micromachined microphones based on semiconductor technology, in microphones in battery-operated equipment, sensitive microphones, and microphones with a high signal-to-noise ratio.

Figure 2:
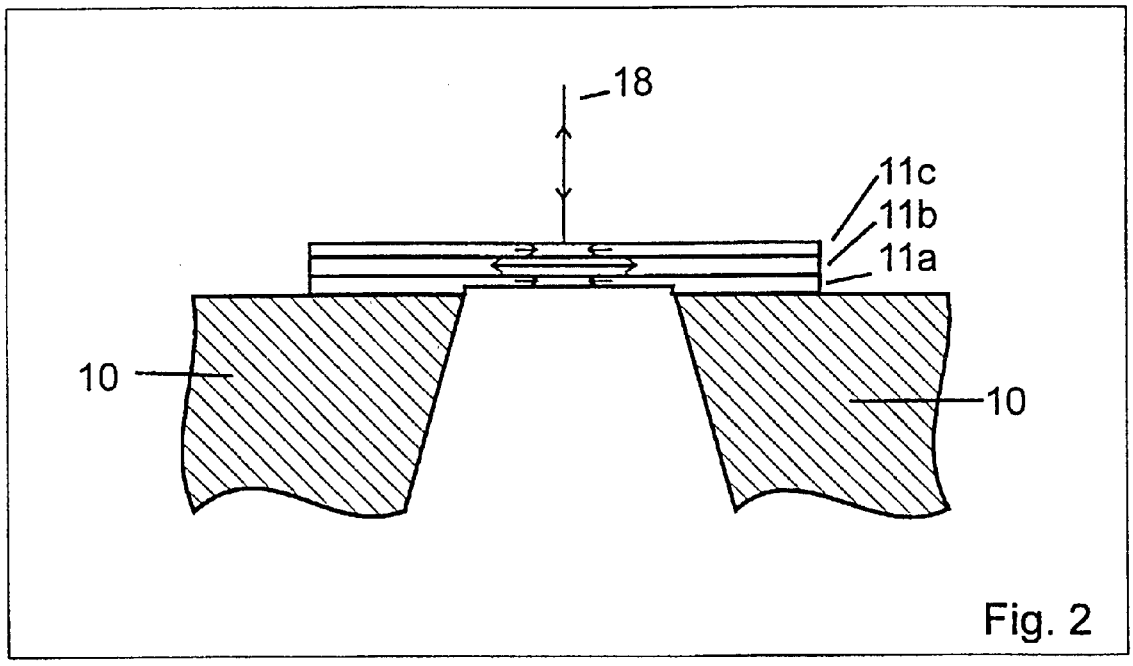

In the following the invention will be explained by way of example with reference to the figures in which FIG. 1 is a cross section through a condenser microphone, and FIG. 2 shows schematically the microphone of FIG. 1 during the process of adjusting the thickness of the diaphragm.

The microphone in FIG. 1 has the following structure. A substrate 10 carries a diaphragm or membrane 11 by means of an intermediate spacer 12 between the substrate 10 and the diaphragm 11 on the opposite side of the diaphragm a back plate 13 is situated with an intermediate spacer 14 between the back plate 13 and the diaphragm 11. The diaphragm 11 has three layers 11*a*, 11*b* and 11*c*.

The substrate 10 consists of bulk crystalline silicon and the backplate 13 consists of polycrystalline silicon. The spacers 12 and 4 consist of an electrically insulating material, which in this case is silicon dioxide $SiO_2$. Of the three layers of the diaphragm, the intermediate layer 11*b* consists of polycrystalline silicon, and the two outer layers 11*a* and 11*c* consist of silicon nitride. The diaphragm 11 is thin and its tension is low so that it is "soft" and movable about the shown position, where it is in equilibrium.

The insulating spacer 14 provides an air gap 15 between the back plate 13 and the diaphragm 11, and the back plate 13 has a number of openings 16 giving access of sound to the air gap 15 and the diaphragm 11. On the opposite side of the diaphragm there is a back chamber 17, which is an opening in the substrate 10. If desired, the back chamber 17 can be connected to a further volume for acoustical purposes.

The diaphragm 11 and the back plate 13 are both electrically conductive, and together they form an electrical capacitor. Sound entering through the openings 16 in the back plate 13 will reach the diaphragm 11 and will cause it to move in response to the sound pressure. Thereby the capacitance of the microphone will change correspondingly, since the air gap determines the capacitance. In operation the capacitor formed by the diaphragm 11 and the back plate 13 is charged with an electrical charge corresponding to a DC voltage, and when the capacitance varies in response to the varying sound pressure, an electric AC voltage corresponding to the varying sound pressure will be superimposed on the DC voltage. This AC voltage is used as the output signal from the microphone.

The process for manufacturing a microphone with the structure shown in FIG. 1 and described above involves mainly known technology. The polycrystalline silicon is itself a semiconductor but can if desired be made conducting by doping with suitable impurities such as boron (B) or phosphorus (P). The two outer layers 11*a* and 11*c* of the diaphragm consist o silicon nitride, which in combination with the B- or P-doped polycrystalline silicon in the intermediate layer of the diaphragm is particularly advantageous, as will be explained later.

As indicated in the figures, the intermediate layer 11*b* of the diaphragm consisting of B- or P-doped polycrystalline silicon has a compressive internal stress $\sigma<0$, whereas the two outer layers 11*a* and 11*c* consisting of silicon nitride both have a tensile internal stress $\sigma>0$, which need not be of the same size. The total or resulting tension of the diaphragm is the sum of the tension in the three layers 11*a*, 11*b* and 11*c* of the diaphragm. In each layer the stress is due to two factors. One factor is the technique used when depositing or building up the layer. This stress is called built-in stress. Another factor is the stress induced by a difference in thermal expansion coefficients of the different materials and is called thermal stress. Both stress contributions can be controlled, as will be explained in the following.

The built-in stress can be relieved by the following method. The spacer material retaining the diaphragm consists of silicon dioxide which is a glassy material having a glass transition temperature. By heating the individual microphone shown in FIG. 1 or rather the whole wafer including several identical microphones to a temperature above the glass transition temperature of the spacer material, the spacer material will become viscous and loose its stiffness. Therefore, in this state the tension in the diaphragm will become completely relieved, since the viscous spacer material can not transfer any strain. Following this the wafer is cooled. During cooling the spacer material will solidify and below the glass transition temperature the diaphragm will again become retained. During cooling below the glass transition temperature, due to thermal expansion and contraction, the diaphragm will regain some tension, which is due to the material properties, which is referred to above as thermal stress.

The thermal stress can be controlled by the following method. First, the actual tension and thickness of the diaphragm is measured and the actual stress calculated. The desired tension is achieved by calculating the necessary thickness adjustment considering the actual stress. There are several useable methods of measuring the actual tension of the diaphragm.

One method of measuring the actual tension of the diaphragm is a test which involves pressurising the diaphragm of the microphone which causes the diaphragm to bulge, ie the diaphragm is given a unidirectional deflection. In practice this is done by pressurising a test diaphragm on the wafer. FIG. 2 shows a beam of light 18, and preferably a laser beam which is directed onto the test diaphragm. This is done in the unpressurised state and also in the pressurised state, and the laser beam 18 will be reflected from the surface of the diaphragm. The bulging of the diaphragm caused by the pressurisation can e.g. be registered by an auto-focus system. When the deflection of the diaphragm and the air pressure causing the bulging are known, the actual tension of the diaphragm can be calculated.

In another method of measuring the tension the diaphragm is excited thereby causing the diaphragm to oscillate. The excitation can be done either electrically or mechanically. When exciting the diaphragm with a pulse with a short duration, the diaphragm will oscillate at its resonance frequency, which can be measured. The excitation signal can also be a sinusoidally oscillating force or voltage that is swept through the frequency range of interest for measuring the resonance frequency. When the resonance frequency of the diaphragm is known, this can be used together with the other mechanical parameters of the diaphragm such as its dimensions and material to calculate the actual tension of the diaphragm.

A third method for determining the tension uses test structures on the wafer which work as strain gauges.

When the actual tension and thickness of the diaphragm is known the actual stress can be calculated. It can then be calculated how much the thickness of the diaphragm needs to be adjusted in order to obtain the desired tension.

The microphone is preferably manufactured so that its diaphragm at this stage is too thick and therefore has a too high tension. From the above calculation of the desired thickness it is known how much material should be removed in a subsequent etching process that can be either dry or wet etching. As shown in FIG. 3 the layer 11*a* having a tensile stress is etched. This is done by etching slowly in a well controlled process, until precisely so much of the layer 11*a* as needed according to the calculation is removed by etching, and the diaphragm has obtained its predetermined tension.

If the diaphragm has a too low tension, extra material having tensile stress can be deposited by known methods to obtain the predetermined tension.

Alternatively, if the diaphragm has only two layers with opposite internal stress, the layer having a compressive stress can be etched in order to increase its tension.

In general, the tension of the diaphragm can by this method be shifted towards higher tension by etching a layer having relatively compressive stress or by depositing material having relatively tensile stress, and correspondingly, the tension of the diaphragm can be shifted towards lower tension by etching a layer having relatively tensile stress or by depositing material having relatively compressive stress.

The above methods of relieving the material stress and of controlling the thermal stress can be performed independently of each other, and it is possible to use either of the methods alone ie without the other, or they can be used in combination.

What is claimed is:

1. A method of manufacturing a micromachined transducer comprising a substrate and a diaphragm, the diaphragm being movable about a position of equilibrium relative to the substrate, the method comprising the steps of:

providing the substrate, providing the diaphragm, placing a substance having a glass transition temperature between the diaphragm and the substrate, heating the substance to a temperature at least equal to said glass transition temperature, cooling the substance to a temperature below the glass transition temperature, and adjusting the diaphragm to a desired tension.

2. The method according to claim 1, wherein the substance having a glass transition temperature is $SiO_2$.

3. A method of manufacturing a micromachined transducer having a substrate and a diaphragm being movable about a position of equilibrium relative to the substrate, the method comprising the steps of:

providing the substrate, providing the diaphragm, said diaphragm including two layers of different stress properties, measuring a tension of the diaphragm, and adjusting a thickness of said diaphragm to provide a desired tension therein.

4. The method of claim 3, wherein the step of adjusting the thickness of the diaphragm comprises etching a surface of the diaphragm.

5. The method of claim 3, wherein the step of adjusting the thickness of the diaphragm comprises depositing material on a surface of the diaphragm.

6. The method of claim 3, wherein the diaphragm has an intermediate layer consisting of polycrystalline silicon and outer layers consisting of silicon nitride on respective sides thereof.

7. The method according to claim 3, including the steps of pressurizing the diaphragm to deflect the diaphragm, measuring the deflection of the diaphragm, and, based on the measured deflection, calculating the tension on the diaphragm.

8. The method of claim 7, including the steps of directing a beam of light onto the diaphragm so as to be reflected therefrom, and calculating the deflection of the diaphragm based on changes in the direction of reflected light.

9. The method of claim 3, including the steps of exciting the diaphragm to vibrate, measuring a resonance frequency of the diaphragm, and based on the measured resonance frequency, calculating the tension of the diaphragm.

* * * * *